US006117503A

United States Patent [19]

Lee et al.

[11] Patent Number: 6,117,503

[45] Date of Patent: Sep. 12, 2000

[54] METHOD OF MAKING AN ARTIFICIAL TREE

[75] Inventors: Tim Wing Him Lee; Charles Wai Keung Lee, both of Kowloon, The Hong Kong Special Administrative Region of the People's Republic of China

[73] Assignee: H&P Sales, Inc., Vista, Calif.

[21] Appl. No.: 09/153,557

[22] Filed: Sep. 15, 1998

[51] Int. Cl.[7] ..... A01N 3/00

[52] U.S. Cl. ..... 428/18; 156/61; 428/32

[58] Field of Search ..... 156/61; 428/18, 428/20, 32, 19; 427/221

[56] References Cited

U.S. PATENT DOCUMENTS

| | | | |
|---|---|---|---|
| 4,386,480 | 6/1983 | Horowitz | 428/20 X |
| 4,399,172 | 8/1983 | DeCosmo . | |
| 4,656,065 | 4/1987 | Yacovella | 428/17 |
| 4,792,471 | 12/1988 | Lee | 428/17 |
| 5,487,476 | 1/1996 | Barfield . | |
| 5,677,017 | 10/1997 | Freeman | 428/17 |
| 5,679,189 | 10/1997 | Jarboe . | |

*Primary Examiner*—Deborah Jones
*Assistant Examiner*—Wendy Boss
*Attorney, Agent, or Firm*—John J. Murphey

[57] ABSTRACT

The invention is a process of simulating rough bark on an artificial tree comprising the steps of coating the artificial tree surface with a thin layer of plastic foam and exposing the foam to a blast of concentrated heat sufficient to collapse part of the foam structure.

21 Claims, 6 Drawing Sheets

METHOD OF MAKING AN ARTIFICIAL TREE

BACKGROUND OF THE INVENTION

1. Field of the Invention

This invention pertains to the flora industry. More particularly, this invention pertains to the field of processes for making artificial flora, such as artificial trees like the Ficus tree, and to a unique process of making them inexpensively, from readily available materials, to form a safe, easy-to-ship product.

2. Description of the Prior Art

The use of flora, such as plants, flowers, bushes, and the like, has been an American tradition for many, many years. It has even extended from exterior the home or office to inside those places and now occupies a rather large portion of personal decoration to one's living as well as working space. Many of these natural plants and such have been specially developed to withstand the rigors of inhospitable weather climates as well as smokey or other polluted conditions found inside the work place and home and wet, smog-filled conditions near certain factories and in some towns.

There are, however, many places, including climates, that are inhospitable to such flora and, in those areas, the only decorative flora that will last any reasonable time are artificial plants and flowers. Thus, a large industry has emerged where the same natural decorative flowers, plants and bushes are made artificially from plastics and the like such that they can adorn homes and offices where otherwise no such flora could flourish. The processes for making these artificial flora are many and varied and, in many cases, become very expensive as the detail needed to simulate real flora requires more and more manual effort.

For instance, certain flowers have straight, smooth-surfaced stems with flat leaves with a flower located on each stem. With these flowers, one only has to make straight stem pieces, flat leaves and single flowers and assemble them in appropriate fashion. However, other flora, such as the Ficus tree, has a rough-surfaced, main trunk with numerous narrow-diameter rough-surface vines entangled about the trunk and each other with "wavy" leaves and few, if any, flowers. These trees are almost impossible to make artificially, not only because of the weave of the vines about the central trunk, but because of the roughness of the bark that covers the trunk and vines. To make such a tree requires extreme amounts of manual effort thus producing an artificial tree with a large selling price; so large, in fact, that in many cases it is cheaper to use real Ficus trees and replace them with new real Ficus trees as the existing trees die from the inelement environment surrounding the tree.

SUMMARY OF THE INVENTION

This invention is a unique process of making an artificial tree, such as a Ficus tree. The process involves the unique step of forming a thin layer of plastic foam on the surface of the artificial trunk and vines and then exposing the foam to a blast of flame or concentrated heat to cause the foam to partially collapse forming a rough surface almost indistinguishable from the rough surface on the trunk and vines of a real Ficus tree. The trunk and vines are made of inexpensive plastic tubing and pipe thus lowering the overall cost of manufacture of the artificial tree. In addition, metal wires may be inserted into the vines and branches to make them more life-like in arrangement. While the pipes and tubing are made of plastic and might possibly burn in an accidental fire, the foam can be loaded with fire retardants to render the artificial product flame retardant. All this can be accomplished without any deterioration in the rough exterior formed on the trunk and vines by subjecting the flame retardant-loaded foam to a blast of flame.

The leaves are made by silk screening onto a sheet of heat-deformable plastic cloth, cutting out the leaves and then placing them in a mold where slight heat is applied to transform the flat leaf into one having waves or slight curls heat-formed therein. This provides a wavy leaf that more closely simulates the real leaf of the Ficus tree.

With the use of a center trunk of plastic pipe and vines wrapped thereabout, all of plastic and all carrying the rough surface formed by the unique step of subjecting a thin layer of foam to a blast of flame, any number of bushes, shrubs and trees can be made from this inventive process including the Ficus tree, the Topiary tree, and others.

Even further, the surface produced by this flame-on-foam process is rugged and can remain undamaged during shipment from the manufacturing plant to various locations distant therefrom in order to allow assemblers to make a wide variety of artificial trees and shrubs from the individual trunks and vines.

The invention is a process of making an artificial tree generally comprises the steps of positioning a rigid pipe, defined by a first diameter and a length determined by first and second distal ends, as a central tree trunk, weaving a plurality of flexible plastic tubing, each having a diameter less than that of the pipe, about the rigid pipe from the first distal end to the second distal end to form an assembly of plastic tubes and pipe, coating the exterior surfaces of the assembly with a thin layer of plastic foam, exposing the foam-covered assembly to a blast of concentrated heat sufficient to collapse part of the foam structure and form a rough surface simulating the bark on a tree and vines, and painting and finishing the assembly with branches and leaves to form the artificial vine-wrapped tree trunk.

Accordingly, the main object of this invention is a process of making an artificial tree using a unique step of coating the artificial trunk and vines with a thin layer of plastic foam and subjecting the foam to a blast of concentrated heat such as from a flame so that some of the foam breaks down or changes shape to form a rough surface truly matching the rough surface of bark or exterior surface of a real Ficus tree and other such non-smooth exterior flora. Other objects include a means of rendering plastic tubes and pipe flame retardant by loading the foam with flame and fire retardants before coating the pipe and tubing; a means of producing pipe and tubing assemblies having a vine-like exterior for use in making a wide variety of artificial plants for decorative use in homes and offices where surrounding environments prevent the use of real flora; a means of making branches that may be manipulated by placing metal wire in the center thereof to change the arrangement characteristics of the branches; a means of producing individual artificial tree trunks and branches in assemblies for bulk shipment to assemblers located elsewhere to allow assembly at locations apart from the manufacturing location of a wide variety of artificial flora.

These and other objects will become more apparent when reading the subsequent Description of the Preferred Embodiments taken together with the drawings appended hereto. The scope of protection desired by the inventors may be gleaned from a fair reading of the claims that conclude this Specification.

DESCRIPTION OF THE PREFERRED EMBODIMENTS

Figure 1:
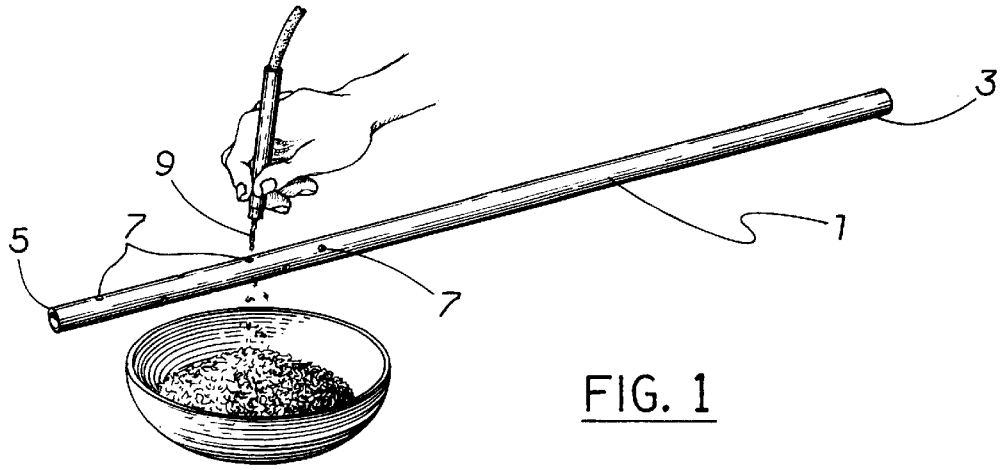
FIG. 1 is an illustrative view of the step of starting with a central plastic pipe and forming apertures in the pipe for later attachment of branch connectors.

Turning now to the drawings where elements are identified by numerals and like elements are identified with like numerals throughout the 23 drawings, the invention involves the novel process of simulating rough bark on an artificial tree that comprises the steps of coating the artificial tree surface with a thin layer of plastic foam and exposing the foam to a blast of concentrated heat sufficient to collapse part of the foam structure. This partially collapsed foam structure is than coated, either sprayed or painted with a brush, with a colored paint, such as a brown paint to simulate the color of the tree bark, and used to complete the product.

A wide range of plastic foams are usable herein such as thermoplastic foams, thermosetting foams and mixtures thereof Thermosetting foams are generally preferred because once they become set after partial collapsing with the blast of concentrated heat, they are rather impervious to further deformation notwithstanding later heat from a warm office or home environment. Thermoplastic foams have a tendency to further deform with heat which makes them poor candidates albeit still somewhat useful in certain instance. One of the best foams useful herein is polyurethane foam which is a thermosetting foam product of a polyester resin and an isocyanate such as toluene diisocyanate or an amide such azodicarbonamide.

It is desired to render the products of this process non-flammable to comply with various state and federal fire codes. In addition, it is clear that customers would choose an artificial tree for indoor use if they knew it was flame retardant. To do so, the process may be slightly modified to pre-loaded the foaming formulation with at least one fire-retardant compound such as antimony trioxide, stannous oxide, aluminum oxide trihydrate, and zinc borate or other such compound. These materials, when used in appropriate quantities to render the assembly of parts non-flammable, do not degrade the foam formulation thus allowing this novel process to proceed.

The step of applying a thin layer of plastic foam to the surface of the item may be accomplished by spraying the item with a foamable combination of materials that generate the foam after being sprayed thereon. Other applications include painting the item with a brush dipped in a foamable formulation. However, spraying the formulation on the item is the most convenient and efficient manner of application.

The step of exposing said foam to a blast of concentrated heat to collapse part of the foam structure may be accomplished in many ways and the outcome will generally be the same. The most efficient manner is to expose the foam to a continuous blast of flame-generated heat that is passed back and forth across the foam. This can be accomplished by having a person sweep a flame of burning propane or natural gas across the foam much the same as a painter would do with a brush. This "hit and miss" application of concentrated flames and heat produces a beautiful artificial "bark" surface in the foam with areas of collapse, areas of slight peeling, areas of creases and folds such as are found on real branches and trunks of trees and bushes. In fact, by using this method, even tree growers often mistake the flame-produced foam-bark for the real bark of real trees and bushes.

Other means of performing the foam-collapsing step includes exposing the foam to a series of blasts of flame-generated heat. This can produced by opening and closing the fuel control valve on the burner so that the flame is alternately large and then small. This simulates the sweeping motion of the above-described step of exposing the foam to a flame and can produce the same or very similar real-looking bark and tree and bush coverings. The preferred fuel to produce the flame is propane.

As shown in the drawings, this process is used to make an artificial tree such as a Ficus tree. In doing so, FIG. 1 shows the first step of the first step is to obtain a length of rigid, hollow pipe 1, such as PVC pipe, of a first size such as 1 to 1½ inches in nominal diameter and cut it to a length defined by first and second distal ends 3 and 5 respectively to serve as a central tree trunk. A plurality of holes or apertures 7 are formed or bored in pipe 1 preferably along the entire length thereof from end 3 to end 5. FIG. 1 shows apertures 7 being formed in pipe 1 by use of a drill 9.

Figure 2:
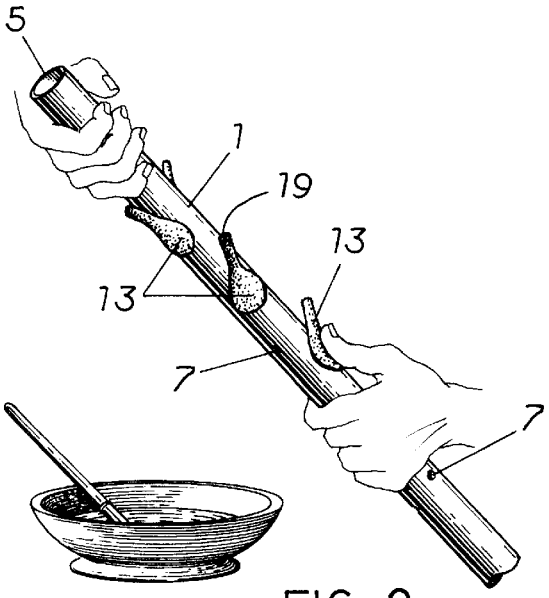
FIG. 2 is an illustrative view of the step of the step of attaching branch connectors to the apertures formed in the pipe.
Figure 3:
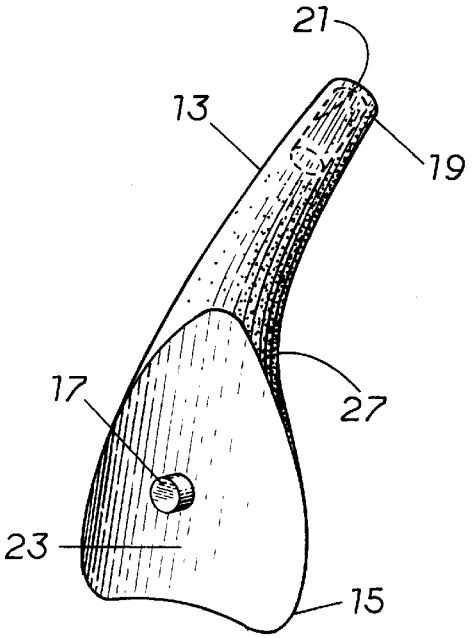
FIG. 3 is a trimetric view of a typical branch connector attached to the central pipe.

As shown in FIG. 2, a branch connector 13 is attached to pipe 1 at each aperture 7 formed therein using a glue to insure it remains in fixed position thereon. As shown in FIG. 3, branch connector 13 is generally triangular in appearance having a wide base 15 preferably containing an outwardly extending nub 17 for insertion into aperture 7 that narrows down to a narrower branch-attachment area 19, having an inwardly directed bore 21, for later receipt therein of a branch, and wherein base 15 and area 19 are set in spaced-apart arrangement as shown. The underside or inner surface 23 of connector 13 is curved to fit against the outer curvature of pipe 1 while the top side or outer surface 27 is textured to that of bark on a tree. Branch connector 13 is usually made by injection molding. It is preferred that branch connectors 13 are set so that they all aim in a common direction toward one distal end 5 of pipe 1 so that they simulate the actual connection of branches to a tree trunk. Finally, it is preferred that, after assembling branch connectors 13 with rigid pipe 1, bores 21 be temporarily capped to prevent the later applied foam from entering therein and interfere with later connecting branches to branch attachment areas 19.

Figure 4:
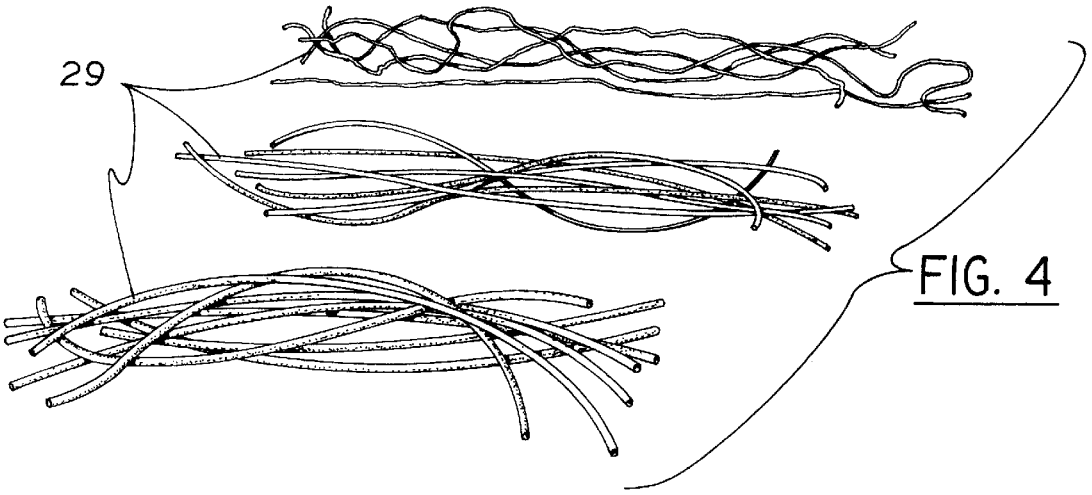
FIG. 4 is an illustrative view of the different diameter plastic tubing used in this invention to make the assembly.
Figure 5:
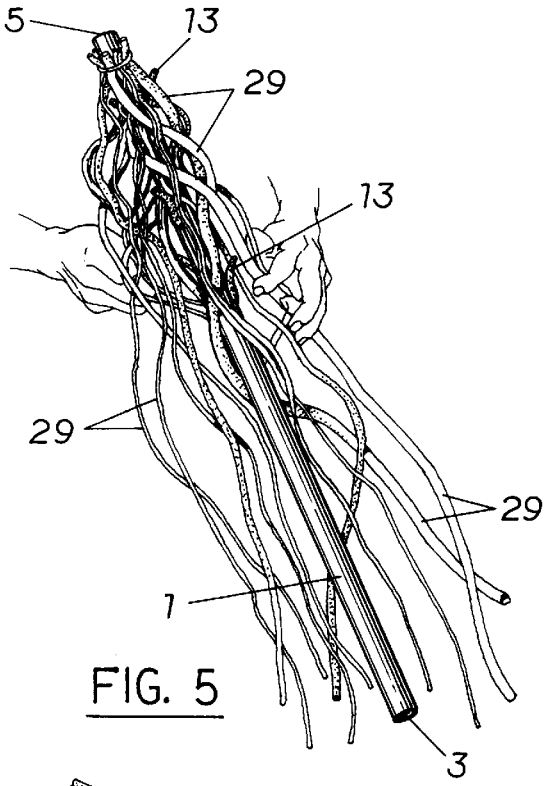
FIG. 5 is an illustrative view of the step of wrapping lengths of flexible tubing of various diameters, all smaller than the pipe, about the pipe to simulate vines and branches to form an assembly.

FIG. 4 shows a plurality of long lengths of flexible plastic tubing 29, each said tube having a diameter less than the diameter of rigid pipe 1, are chosen in groups simulating different diameter branches or vines that grow in adjacent contact with the Ficus tree. FIG. 5 shows the plurality of tubing 29 to be wrapped about rigid tube 1, usually by hand but in no special pattern except to start at one distal end and proceed to the other distal end, to form an assembly 31 of tubing 29 with central pipe 1. The plurality of flexible plastic tubing 29 simulates vines and branches growing up and about the Ficus tree central trunk. The plurality of flexible plastic tubing 29 may be comprised of tubing of many different nominal diameters, from very small or thin to a thickness approaching one-third to one-half the nominal diameter of central Ficus tree trunk-pipe 1. The wrapping is usually done by hand and the flexible tubes are usually tied tightly to the trunk tube at both distal ends thereof, and then one end of the tree trunk acts as the bottom of the tree and the other end represents the top of the tree. The distal end of the tree acting as the top must be the end to which the narrow branch attachment areas 19 of branch connector 13 are pointed.

Figure 6:
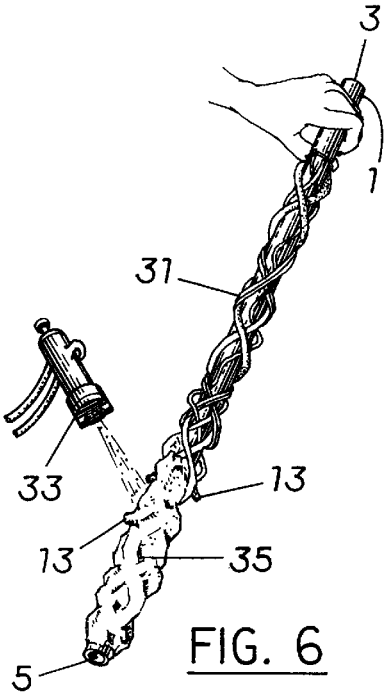
FIG. 6 is an illustrative view of the step of applying foam to the exterior surfaces of the assembly.

The exterior surfaces of assembly 31, comprising rigid pipe 1 and interwoven flexible tubing 29, is thereafter coated with foam 35. FIG. 6 shows assembly 31 being sprayed from a nozzle 33 with a liquid foaming mixture 35 that coats all of the surface area of assembly 31 and thereafter generates a thin film of foam. This is the preferred method although it is possible to separately coat pipe 1 and separately coat each length of flexible tubing 29 with foam before assembling them. However, the handling of foam-covered pipe and tubing is more difficult and the foam may be damaged if handled too severely. After the foam is set, i.e., is completed its generation and becomes dry, assembly 31 is then treated with a blast of concentrated heat to collapse the foam and produce the outer bark texture on the entire assembly.

Figure 7:
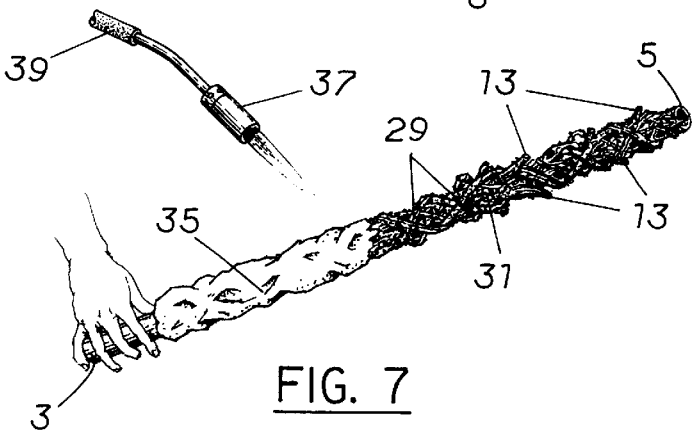
FIG. 7 is an illustrative view of the step of exposing the foam to a blast of concentrated heat to break some of the foam and produce the desired bark structure.

FIG. 7 shows the foam being subjected to blasts of concentrated heat such as flame from a nozzle 37 attached to a hose 39 that leads from a propane tank (not shown). The flame is washed back and forth over the foam, as assembly 31 is turned, to provide a blast of heat to all areas of the foam. This heat causes the foam to break down to form the unique textured surface simulating the bark on an actual Ficus tree.

Figure 8:
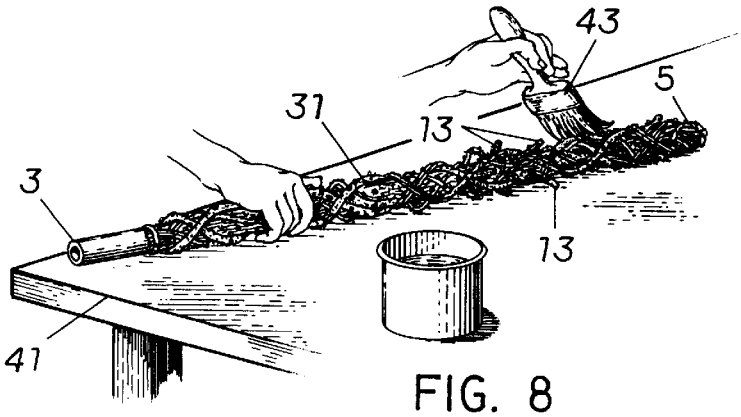
FIG. 8 is an illustrative view of the step of applying a coat of paint the surface of the assembly to simulate the bark surface of the tree.
Figure 9:
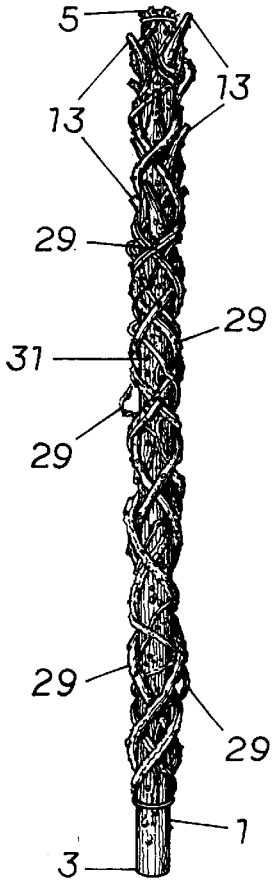
FIG. 9 is a side view of the completed assembly of pipe and tubes prior to the addition of branches and leaves.

The assembly is then painted. FIG. 8 shows assembly 31 laid on a table 41 and the operator applying colored paint to simulate the brown color of the bark. It has been found that applying the paint with a paint brush 43 creates areas of light color and areas of deep color to be developed in the surface further adding to the texture simulating real bark. FIG. 9 shows assembly 31 fully built, coated with foam, the foam textured and the paint applied and dried.

Figure 10:
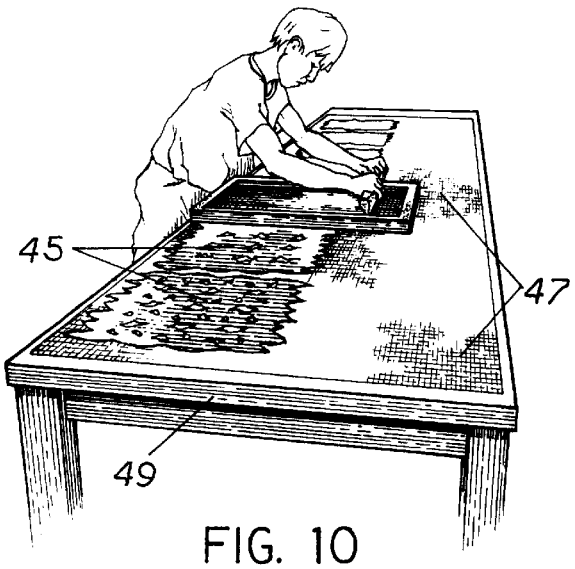
FIG. 10 is an illustrative view of the step of silk screening a leaf design on a layer of cloth.
Figure 11:
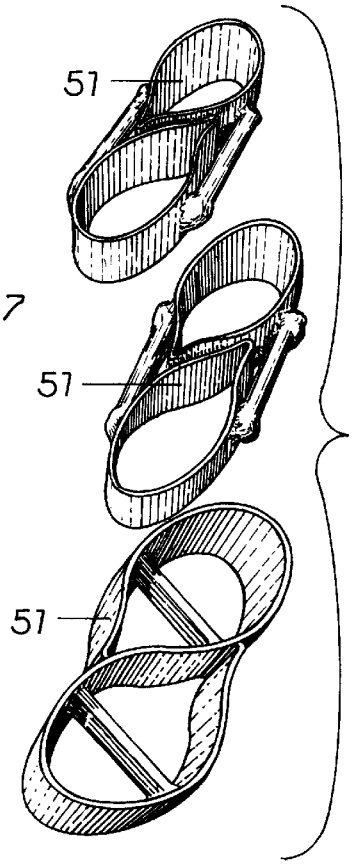
FIG. 11 is an illustrative view of various sizes and shapes of dies to cut the leaves from the cloth.
Figure 12:
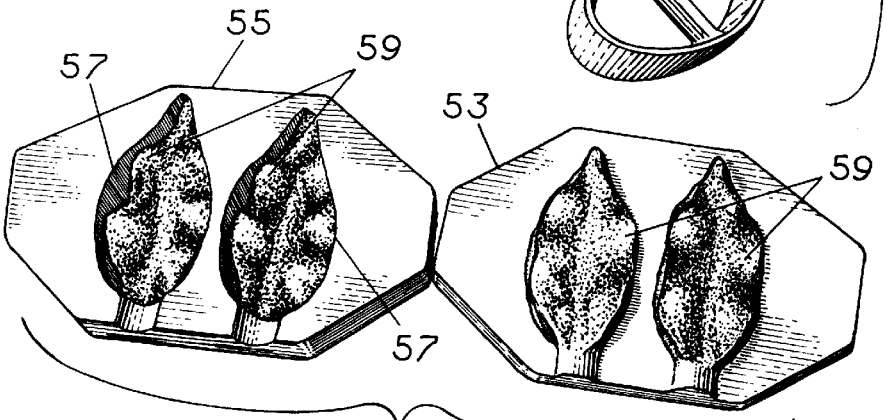
FIG. 12 is an illustrative view of a mold used to mold branch junctures.
Figure 13:
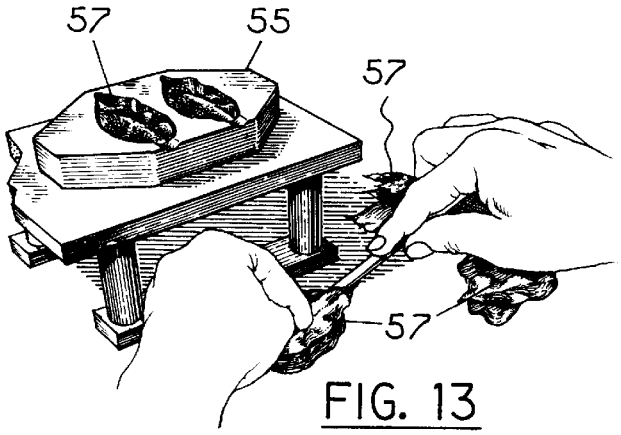
FIG. 13 is an illustrative view of the step of removing the molded leaves from the shaping mold.

The branches and leaves that are later attached to branch connectors 13 are made by first silk screening a leaf pattern on a layer of cloth. FIG. 10 shows a workman silk screening a leaf pattern 45 onto a heat shrinkable cloth 47, such as Dacron cloth, that is spread over a table 49. The material silk screened is a thermosetting plastic composition that has been colored to resemble the color of the particular leaf desired. As shown in FIG. 11 different sizes and shapes of cutting dies 51 are used to cut the silk screened leaf-patterns 45 from cloth 47. Each leaf is then cut from the layer of cloth 47 and arranged in stacks in a mold that is textured to the curvature of the particular leaf. FIG. 12 shows the open female mold 55 in the shape of a leaf 57 having contours 59 formed therein in which artificial leaves are stacked, mold 55 is closed with male mold 53 and light heat (180° F.) is applied to form the leaves to the curvature of the mold. The curved leaves 57 are then removed from the mold and separated (see FIG. 13).

Figure 14:
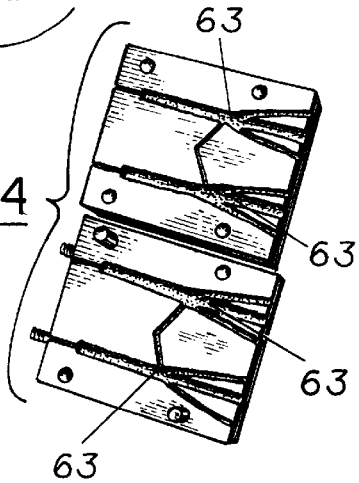
FIG. 14 is an illustrative view of a mold used to mold branch junctures.
Figure 15:
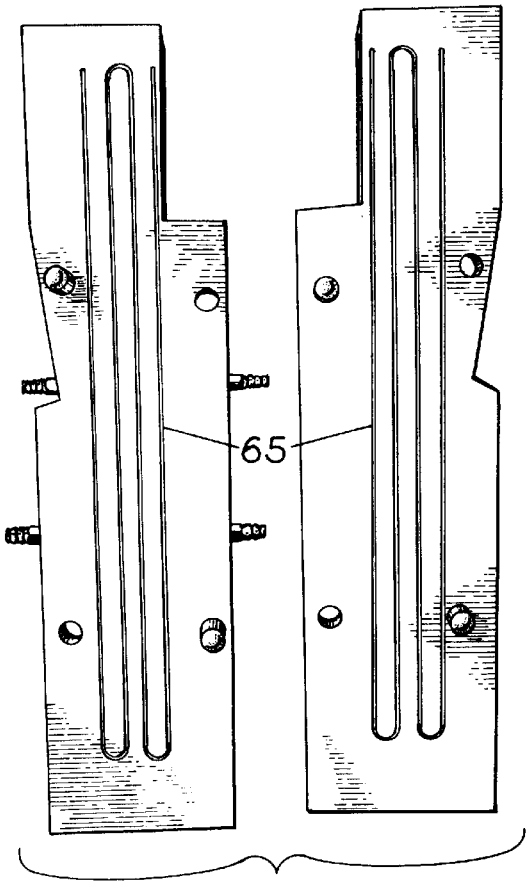
FIG. 15 is an illustrative view of the step of making subassemblies of branches and fittings.
Figure 16:
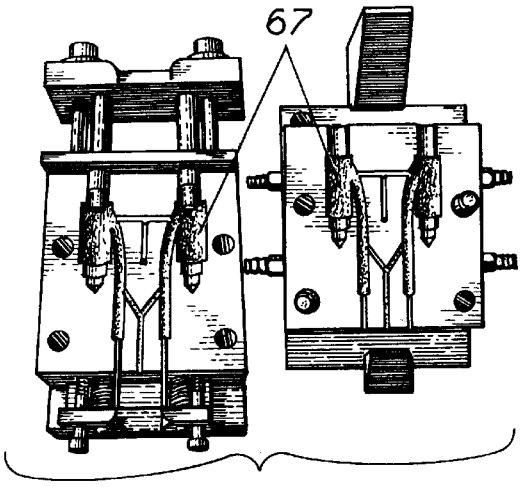
FIG. 16 is an illustrative view of a mold for making branch connectors.
Figure 17:
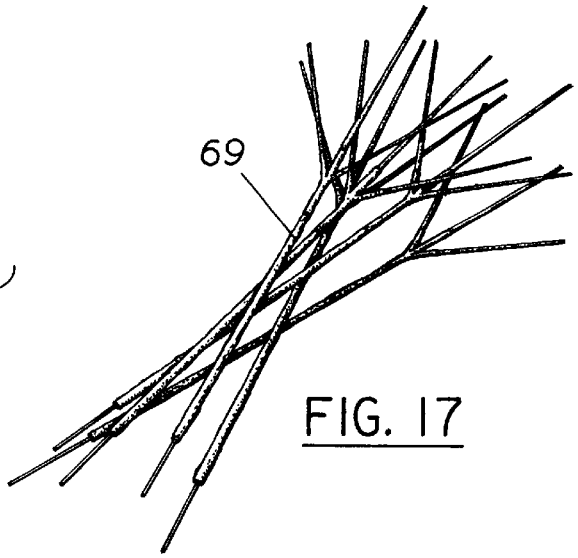
FIG. 17 is an illustrative view of the branches in their incomplete form.
Figure 18:
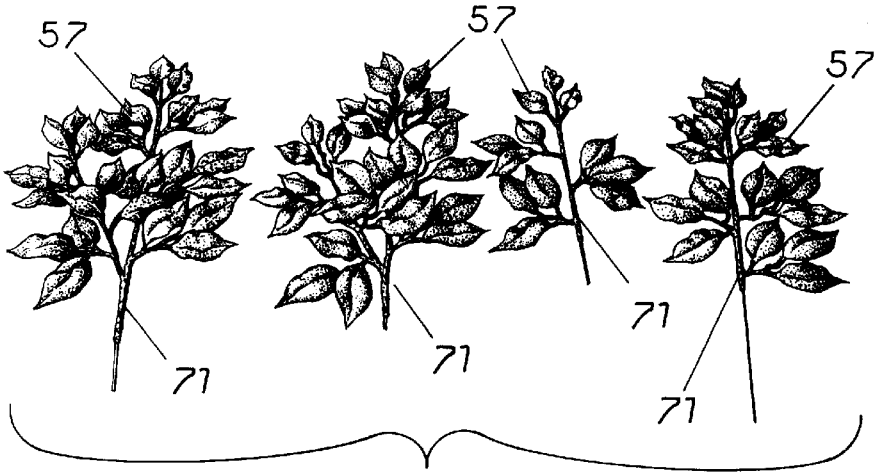
FIG. 18 is an illustrative view of completed branches ready to be to be attached to the assembly of pipe and flexible tubing to form the Ficus tree; and, FIG. 19 is a side view of a almost completed tree made from the process of this invention.
Figure 19:
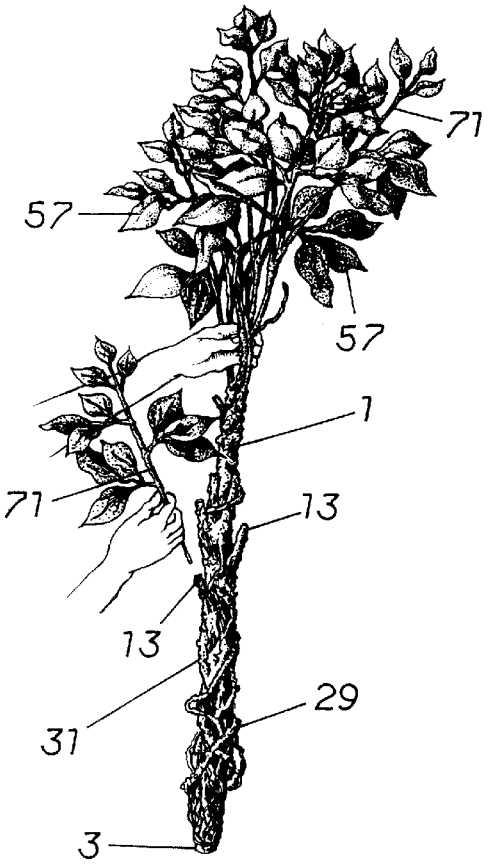

As shown in FIGS. 14, 15 and 16, molds are used to mold branch junctures 63, shapely branches 65 and branch attachments 67 by injection molding techniques. In this step, the mold is closed and plastic is injected into it to make the part. In the shapely branch molding, contoured leaves 57 are placed at the ends and along the sides of the branch cavity simulating a real branch. A metal wire is sometimes laid in the branch cavity to become embedded in the finished branch to give a certain amount of holding power to the branch when it is used to simulate certain types of bush branches. The stub end of the branch is molded into a shape that allows it to be inserted into the branch attachment area 19 of branch connector 13. These branch pieces are often sub-assembled to form partial branches 69 (see FIG. 17) and later joined with curved leaves 57 to form a variety of whole branches 71 as shown in FIG. 18. Whole branches 71 are then attached to branch connectors 13 as shown in FIG. 19 to form the Ficus tree.

Figure 20:
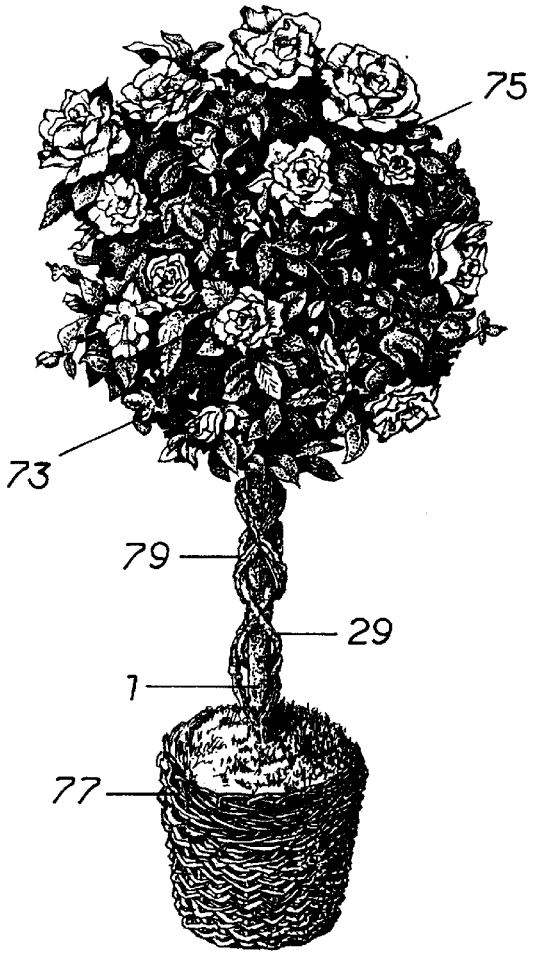
FIG. 20 is an illustrative view of a synthetic Topiary tree made by this inventive process.

While Ficus trees are the main thrust of this inventive process, other trees can be made artificially using this same process. FIG. 20 shows a typical topiary tree 73 in the form of a ball 75 of interwoven flexible tubing 29 (branches 69) mounted in spaced-apart location above a base 77 and supported on a rigid central pipe 1 having a few vines (flexible plastic tubing 29) wrapped about pipe 1 to form a trunk 79 trunk. Interwoven flexible tubing 29 can be woven into many forms of topiary, such as a dolphin, an elephant, and so on.

A further embodiment in this invention is the use of metal wires in the branches of the artificial that are made from "memory"-type metal wire. The prior art practice has historically been to use a cheap metal wire, having no memory, in the center of the branches. This wire gives some stiffness to the branches so they can withstand the roughness of handling in the home or wherever displayed. The nonmemory wire allows the artificial tree to be bundled in a cylindrical package, with the branches directed upward toward the top of the tree, and the packages stacked for shipment. Upon receipt and unwrapping of the package at the destination, the handler requires about 20 to 30 minutes per tree to bend all the branches outward to obtain the proper dress of the tree. Later, should the tree fall over or be knocked over, the branches caught under the tree, between the tree and the floor, mash up against the trunk and remain in that configuration because they have no "memory" of where they had been previously positioned.

The use of "memory" wire in the branches has proved to be remarkable in terms of packaging, handling and general use of the tree. As soon as the packaging is stripped away from the tree, the branches fall outward and immediately assume the pose they had when the tree was manufactured. There is no need to waste time to dress the tree. Further, use of memory wire in the branches makes the branches hold a memory of their shape so that when the tree is knocked or falls over, where some branches are mashed against the trunk, these branches immediately resume their previous shape when the tree is uprighted.

Memory wire of the type used herein is of the formula about 5% by weight Iron, 70% by weight Carbon, and 25% by weight Nickel.

Figure 22:
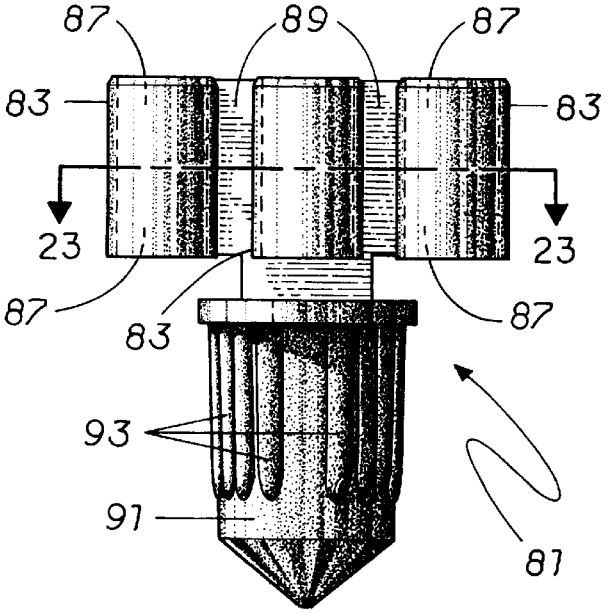
FIG. 22 is a side view of the branch holder and plug.
Figure 23:
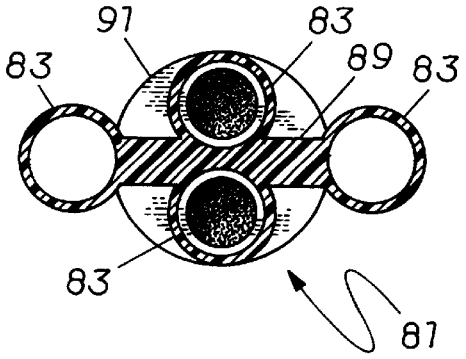
FIG. 23 is a top sectional view of the special branch holder and plug taken along lines 23—23 in FIG. 22.
Figure 21:
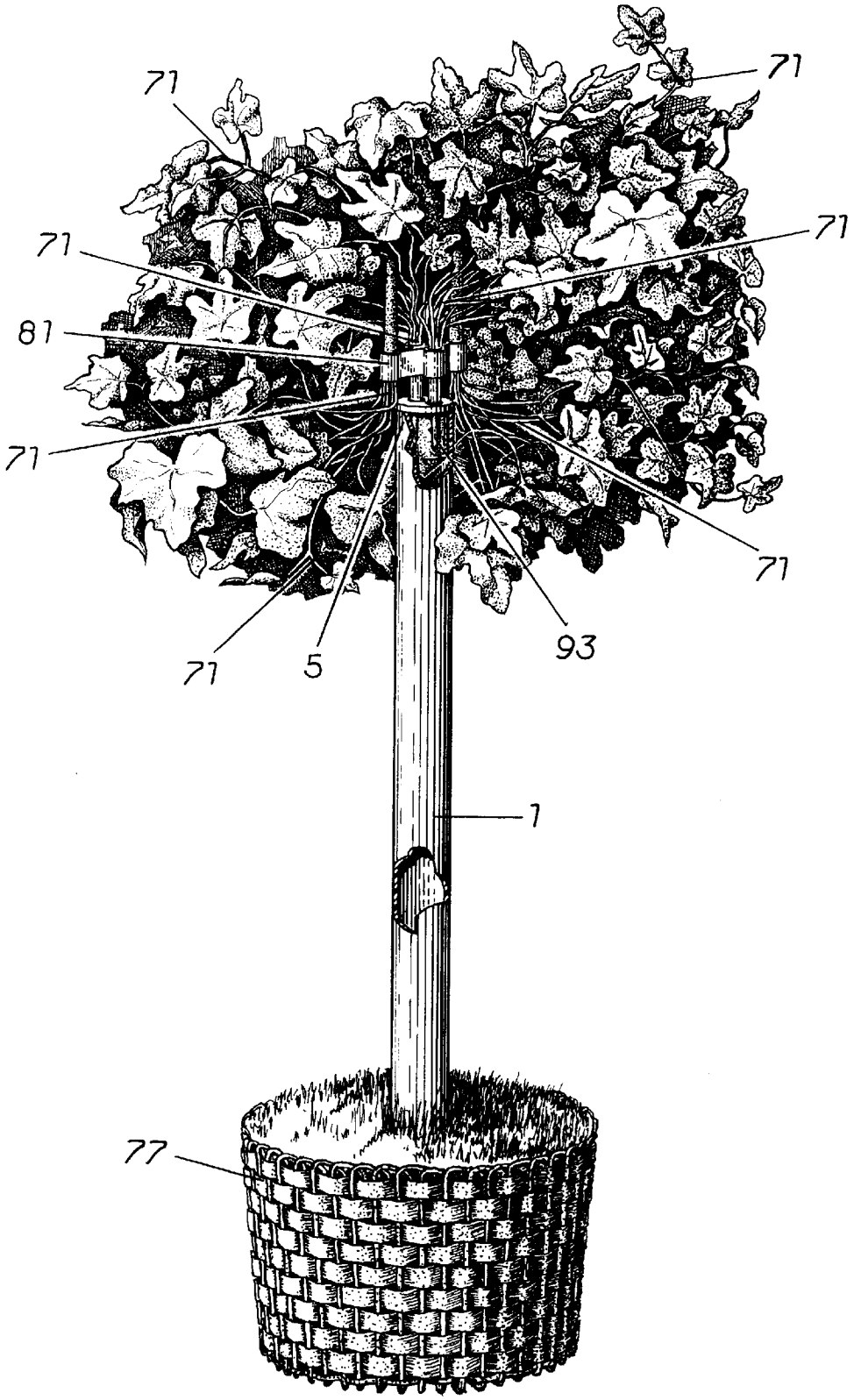
FIG. 21 is a perspective view of a synthetic tree made by this invention and using a special branch holder plugged into the upper distal end thereof to hold together a plurality of preformed branches.

A still further embodiment of the invention is to assemble an artificial tree using only one center, hollow pipe 1, without flexible plastic tubing 29, and setting it vertically upright in a base 77, as shown in FIG. 21. At upper distal end 5 of pipe 1 is mounted a fitting 81, also shown in FIGS. 22 and 23, that comprises a plurality of short hollow cylindrical branch holders 83, having mutually faced-apart opposed opened ends 87, said cylinders preferably held in vertical orientation by a center blade 89 retained in close proximity to a plug 91, of a size and shape that is insertable into open pipe end 5. A plurality of artificial branches 71 are inserted, base-first, into said holders, from both ends 87 of branch holders 83, so that the branches extend above and below holders 83 and plug 91 to form a ball of leafed branches as shown in FIG. 21. At least two of branches 71 extend completely through cylinders 83 into plug 91 and are held therein by adhesive or by molding branch holders 83, center blade 89, and plug 91 with the two branches in a monolithic piece in a mold. This is usually done in a low pressure injection mold using a thermoplastic resin as the material to hold all the parts together or make all the parts at one time. A plurality of elongated raised spacers 93 are formed along the outside surface of plug 91 to create an interference fit when plug 91 in inserted into pipe distal end 5.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A process of simulating rough bark on an artificial tree comprising the steps of:

a) coating the artificial tree surface with a thin layer of plastic foam; and, b) exposing said foam to a blast of concentrated heat sufficient to collapse part of the foam structure.

2. The process of claim 1 wherein the plastic foam is selected from the group consisting of thermoplastic foam, thermosetting foam, and mixtures thereof.

3. The process of claim 1 wherein the plastic foam is pre-loaded with at least one fire-retardant compound.

4. The process of claim 1 wherein the step of coating the artificial tree surface with a thin layer of plastic foam includes the step of spraying the tree with a foamable combination of materials that generate the foam after being sprayed thereon.

5. The process of claim 1 wherein the step of coating the artificial tree surface with a thin layer of plastic foam includes the step of spraying the foam on the tree.

6. The process of claim 1 wherein the step of exposing said foam to a blast of concentrated heat to collapse part of the foam structure comprises the step of exposing said foam to a continuous blast of flame-generated heat.

7. The process of claim 1 wherein the step of exposing said foam to a blast of concentrated heat to collapse part of the foam structure comprises the step of exposing said foam to a series of blasts of flame-generated heat.

8. A process of making an artificial tree comprising the steps of:

a) positioning a rigid pipe, defined by a first diameter and a length determined by first and second distal ends, as a central tree trunk;

b) weaving a plurality of lengths of flexible plastic tubing, each length having a diameter less than that of said pipe, about said rigid pipe from said first to said second distal ends to form an assembly of plastic tubes and pipe;

c) coating the exterior surfaces of said assembly with a thin layer of plastic foam;

d) exposing said foam-covered assembly to a blast of concentrated heat sufficient to collapse part of the foam structure and form a rough surface simulating the bark on a tree and vines; and, e) painting and finishing said assembly to simulate a vine-wrapped tree trunk.

9. The process of claim 8 wherein said step of positioning a rigid pipe, defined by a first diameter and of a length determined by first and second distal ends, as a central tree trunk includes the additional steps of:

a) forming a plurality of small apertures in said central tree trunk from said first distal end to said second distal end; and, b) attaching to said apertures a plurality of connectors, each said connector defined by a broad trunk-joining portion and a narrower branch-connection portion spaced-apart therefrom, said connectors arranged on said trunk to have all their branch-attachment portions pointing to one said distal end of said tree trunk that will serve as the top of said trunk.

10. The process of claim 9 wherein said step of attaching to said apertures a plurality of connectors, each said connector defined by a broad trunk-joining portion and a narrower branch-connection portion spaced-apart therefrom, said connectors arranged on said trunk to have all their branch-attachment portions pointing to one said distal end of said tree trunk said end to serve as the top of said trunk, is followed by the step of temporarily capping said branch-connection portion to prevent said foam from interfering with the later attachment of branches and leaves thereto.

11. The process of claim 10 wherein the step of painting and finishing said assembly to simulate a vine-wrapped tree trunk is followed by the steps of:

a) removing some of the temporary capping and attaching thereto preformed branches including leaves; and, b) leaving some of the caps remaining on said connectors to simulate under-bark growths and failed branches on said tree trunk.

12. The process of claim 8 wherein the plastic foam is selected from the group consisting of thermoplastic foam, thermosetting foam, and mixtures thereof.

13. The process of claim 8 wherein the plastic foam is pre-loaded with at least one fire-retardant compound.

14. The process of claim 8 wherein the step of coating the artificial tree surface with a thin layer of plastic foam includes the step of spraying the tree with a foamable combination of materials that generate the foam after being sprayed thereon.

15. The process of claim 8 wherein the step of coating the artificial tree surface with a thin layer of plastic foam includes the step of spraying the foam on the tree.

16. The process of claim 8 wherein the step of exposing said foam to a blast of concentrated heat to collapse part of the foam structure comprises the step of exposing said foam to a continuous blast of flame-generated heat.

17. The process of claim 8 wherein the step of exposing said foam to a blast of concentrated heat to collapse part of the foam structure comprises the step of exposing said foam to a series of blasts of flame-generated heat.

18. An artificial tree, comprising:

a) a hollow pipe, defined by upper and lower distal ends respectively;

b) a base in which said pipe is vertically mounted at its lower distal end;

c) a holder attached to said pipe upper distal end, including a plurality of short hollow cylindrical branch holders, each having mutually faced-apart opposed opened ends;

d) a center blade connected to said branch holders for holding them in fixed orientation;

e) a plug, of a size and shape arranged for insertion into said open pipe distal end, said plug attached to said center blade so that a plurality of artificial leafed branches, inserted in both ends of said branch holders create a ball of leaves attachable to said top distal end of said pipe creates a ball of leafed branches;

f) a plurality of elongated raised spacers formed along the surface of said plug to create an interference fit when said plug in inserted into said pipe distal end; and, g) a plurality of wires of memory metal inserted therein along the branches thereof to help hold the branches of said tree in proper pose and dress.

19. An artificial tree, comprising:

a) a hollow pipe, defined by upper and lower distal ends respectively;

b) a base in which said pipe is vertically mounted at its lower distal end;

c) a holder attached to said pipe upper distal end, including a plurality of short hollow cylindrical branch holders, each having mutually faced-apart opposed opened ends;

d) a center blade connected to said branch holders for holding them in fixed orientation;

e) a plugs of a size and shape arranged for insertion into said open pipe distal end, said plug attached to said center blade so that a plurality of artificial leafed branches, inserted in both ends of said branch holders create a ball of leaves attachable to said top distal end of said pipe creates a ball of leafed branches;

f) a plurality of elongated raised spacers formed along the surface of said plug to create an interference fit when said plug in inserted into said pipe distal end; and, g) a plural of wires of memory metal inserted therein along the branches thereof to help hold the branches of said tree in proper pose and dress wherein said wires are of the composition 5% by weight iron, 70% by weight carbon, and 25% by weight nickel.

20. An artificial tree with a realistic bark covering made by coating an artificial tree surface with a thin layer of mixed plastic foam ingredients, allowing the foam ingredients to develop into a foam that rises into a coating on the surface of the tree, and exposing the risen foam to a blast of concentrated heat sufficient to collapse part of the foam structure to produce a realistic bark-covered artificial tree.

21. The product produced by the process of claim 8.

* * * * *